United States Patent [19]

Taylor

[11] 4,037,991

[45] July 26, 1977

[54] FLUID-FLOW ASSISTING DEVICES

[75] Inventor: Peter John Taylor, Fareham, England

[73] Assignee: The Plessey Company Limited, Ilford, Essex, England

[21] Appl. No.: 613,415

[22] Filed: Sept. 15, 1975

Related U.S. Application Data

[63] Continuation of Ser. No. 382,689, July 26, 1973, abandoned, which is a continuation of Ser. No. 223,648, Feb. 4, 1972, abandoned.

[51] Int. Cl.[2] ..... F04B 23/14; F04F 5/46

[52] U.S. Cl. ..... 417/80; 417/89; 417/179; 417/197

[58] Field of Search ..... 417/79–83, 417/87, 88, 89, 179, 197; 60/269, 39.48, 39.49; 239/DIG. 7, 265.17

[56] References Cited

U.S. PATENT DOCUMENTS

| | | | |
|---|---|---|---|
| 3,047,208 | 7/1962 | Coanda | 417/197 X |
| 3,306,525 | 2/1967 | Dornier | 60/269 X |
| 3,525,474 | 8/1970 | Ohain et al. | 60/269 X |
| 3,551,073 | 12/1970 | Petrovits | 417/87 X |
| 3,735,778 | 5/1973 | Garnier | 239/DIG. 7 |
| 3,736,072 | 5/1973 | Turner et al. | 417/197 X |
| 3,880,354 | 4/1975 | VanHorn | 239/DIG. 7 |

FOREIGN PATENT DOCUMENTS

| | | | |
|---|---|---|---|
| 613,144 | 1/1961 | Canada | 417/197 |

OTHER PUBLICATIONS

"Experimental Thrust Augmentation of a Variable Geometry, Two Dimensional Coanda Wall Jet Ejector," Aeronautical Report LR-394, National Research Council of Canada, by W. J. Scott.

"Applications of the Canada Effect," *Scientific American,* June, 1966, by Imants Reba.

*Primary Examiner*—William L. Freeh
*Assistant Examiner*—Edward Look
*Attorney, Agent, or Firm*—Scrivener, Parker, Scrivener & Clarke

[57] ABSTRACT

An inlet line connected to the inlet of a hydraulic pump includes a jet pump having a Venturi nozzle though which the aspired liquid is passed, and into which a coaxial jet of liquid under higher pressure is introduced to raise, by jet-pump action, the pressure of the liquid at the pump inlet. In order to increase the efficiency of pressure recovery in the diffusor part of the Venturi nozzle, fuel under higher pressure than the aspired liquid fuel is also introduced into the flow of incoming fuel through the wall of the Venturi nozzle, at a point preceding the throat, via inlet slots so arranged that, when there is a flow of fuel through the nozzle passage, the Coanda effect of the additional fuel thus introduced causes the thus introduced fuel to form a layer moving along the walls of the throat and diffuser portion of the Venturi nozzle, and separating the stationary surface of the throat and diffusor walls from the flow of fluid obtained by the action of the central jet, thereby counteracting the tendency to wall detachment which in conventional jet pumps is caused by boundary-layer action.

3 Claims, 3 Drawing Figures

FLUID-FLOW ASSISTING DEVICES

This is a continuation of application Ser. No. 382,689 filed July 26, 1973, now abandoned, which was a continuation of application Ser. No. 223,648 filed Feb. 4, 1972, now abandoned.

This invention relates to fluid-flow assisting devices hereinafter called injectors, in which the flow of a fluid, hereinafter called main flow, in a duct is assisted by the admission into the duct of a second flow of liquid at a speed higher than the local velocity of the main flow and it has for an object to provide an improved injector which is highly suitable for the feeding of a liquid pump with liquids from a supply that is at so low a pressure as to normally involve the risk of a separation of vapor and/or dissolved gases from the liquid either in the pump or in an inlet duct leading to the pump.

It has previously been proposed to use as such an injector a so-called jet pump, in which a high velocity jet of liquid of the same kind as that to be pumped is injected, in an inlet-line member of the pump, coaxially in the direction of flow with the object of utilizing the kinetic energy of this jet of liquid for increasing the pressure of the liquid at the pump inlet and thus in the pump. While a jet-pump has the advantage of constructural simlicity and does not require any movable element to produce the desired increase in pressure, its efficiency has hitherto been low because the conversion of kinetic energy into pressure energy in a so-called diffusor is greatly affected by boundary layer effects leading to detachment of the flow from the walls of the passage in the diffusor part thereof, and it is a more specific object of the present invention to provide an injector of improved efficiency which employs a jet of liquid from a centrally arranged coaxial jet nozzle for increasing the pressure at the end of inlet-line member of a hydraulic pump.

The invention is based on the discovery that if the inlet line member includes a Venturi-nozzle passage portion having a Venturi throat interposed between a convergent inlet portion and a divergent outlet or diffusor portion, in addition to the coaxially injected high velocity jet, and a liquid of the same nature as the liquid to be pumped is introduced into the convergent inlet portion by a Coanda-slot system arranged in a zone encircling the inlet passage at a point of the length of the convergent passage portion upstream of the Venturi throat in such a manner as to adhere to the passage wall due to the Coanda effect while flowing through the Venturi throat and the diffusor portion towards the outlet end of the Venturi nozzle passage, the liquid thus introduced, in addition to itself producing a certain amount of injector action, will also greatly improve the efficiency of the conversion of the kinetic energy of the liquid injected through the coaxial jet nozzle by forming a layer of longitudinally moving liquid which, due to the Coanda effect, adheres to the solid wall of the diffusor portion, and thus separates the stationary solid wall from the axial flow produced by the jet and thereby greatly reduces the dissipation of energy in the diffusor part compared to the dissipation of energy taking place, due to boundary-layer detachment, in the diffusor part of a jet pump as hitherto constructed.

While the use of a Coanda-slot injection system in the convergent part of a Venturi nozzle passage has been previously described, more particularly in systems for gaseous fluids, as an alternative to a conventional jet pump arrangement employing a coaxial jet nozzle, this previously described arrangement would not be suitable for obtaining the large increase in pressure which is required for the purposes of the present invention, and it had not been recognized that the flow conditions created by such Coanda-slot injection can, according to the present invention be employed to greatly increase the hydrodynamic efficiency of the jet-pump action of a centrally arranged jet nozzle.

According to the present invention an injector comprises the injector body provided with a Venturi nozzle passage having a passage wall forming a throat, an inlet at one side of the throat, a converging inlet portion leading from the inlet to the throat, an outlet at the other side of the throat and a diffusor passage leading from the throat to the outlet, and further comprises a central jet nozzle for injecting a jet of injection liquid coaxially into said converging inlet portion to pass through said throat towards said outlet, said injector body being additionally provided with injection-liquid passage means leading from a point outside said body to an ammo or Coanda-slot system in the inlet portion of said passage wall, said wail and passage being so shaped in the vicinity of each such port or ports as to cause liquid admitted from said injection liquid-pasage to adhere to the passage wall downstream of the port while flowing from the port towards said outlet.

The injector according to the invention offers in comparison to the conventional injector, which is generally known as a jet pump, the advantage that it provides, with the help of the Coanda effect, a forward-moving layer of liquid on the wall of the diffusor part of the nozzle, which layer replaces the stationary boundary layer which is in a conventional jet pump counteracts the detachment of the nozzle flow from the diffusor walls and thereby improves the pressure recovery, in the diffusor, of the kinetic energy introduced by the jet of fuel injected through the central jet nozzle of the kinetic energy of all the flow passing through the throat including that injected through the central jet nozzle, thus permitting injection liquid to be introduced alternatively through the Coanda-slot system only or through both the latter and the central injection nozzle.

When the invention is applied to the feeding of liquid to a pump from a low-pressure supply, a duct leading to the inlet of the pump is, maybe equipped with an injector which comprises a Venturi-type nozzle through the main passage of which the low-pressure liquid is arranged to pass while liquid under is fed to the boundary layer of the Venturi-type nozzle at a point preceding the throat of the nozzle in such a manner as to cause the higher-pressure liquid to be guided by the Coanda effect through the throat and the diffusor portion of the nozzle towards the pump inlet. This aspect of the invention has been primarily designed for, but is not strictly limited to the use in aircraft fuel systems in which fuel from a tank is fed by a booster pump at a relatively low pressure to a backing pump serving to raise the pressure sufficiently to avoid gas or vapor release and cavitation phenomena in a main fuel pump acting against a higher pressure for feeding the burners of a jet engine or similar engine. In this case the jet nozzle operating in the manner described may be provided at the inlet of the backing pump or in the feed line leading from the booster pump to the backing pump, or even in the inlet line leading from the tauh to the booster pump. In the first-mentioned cae, a jet pump arrangement according to the invention may not only be provided to raise the pressure of the main flow of liquid coming from the booster pump but may alternatively be employed to assist in feeding back to the inlet of the backing pump waste liquids, more particularly waste liquids associated with the operation of the aircraft engine, which at present are commonly discharged into the ambient atmosphere, but whose discharge it is intended to avoid in order to reduce the risk of atmospheric pollution. Such waste liquids may comprise fluid leakage from shaft seals, condensation products from the exhaust of the jet engine, lubricating-oil residues, and condensates from a variety of sources, for example water which may contain contaminants in solution or suspension. These liquids will normally be under ambient pressure and enriched with dissolved air. It will be readily appreciated that when these liquids are fed to the backing pump, they will reach the engine burners in admixture with the normal fuel and will largely be converted to harmless combustion products, but that, on the other hand, any further reduction of the pressure under which they are collected, would lead to the liberation of a large volume of gas or vapor which would be liable to interfere with the effectiveness of the backing pump, and the pump would also be liable to be damaged by cavitation phenomena. The invention allows liquids of this kind to be introduced efficiently and conveniently with a minimum of such risk. The arrangement of injector systems according to the invention in the line leading from the booster pump to the backing pump makes it possible to employ if desired a relatively long connecting line even when using a booster pump of relatively low pressure output, more particularly if a number of injector systems are arranged at spaced intervals along the line to prevent the presure in that line to drop at any point to a level at which undesirable separation of vapor or gases from the liquid is liable to occur. In this case the stream of higher-pressure liquid can be kept comparatively low in volume and may in some cases be derived from the booster pump itself, the effect being in that case less one of accelerating the flow or producing a pressure rise across the injector nozzle but rather one of ensuring that movement similar to that in the center of the stream also occurs in the boundary layer, thereby preventing any appreciable pressure drop in the next-following portion of the length of the line. Similarly the use of one or more injector systems in the inlet line to a booster pump enables the booster pump to be mounted in a convenient location, for example above a fuel tank, without undue risk of gas or vapor separation in the inlet line.

In order that the invention may be more readily understood, it will now be described in more detail with reference to the accompanying drawing, in which.

Figure 1:
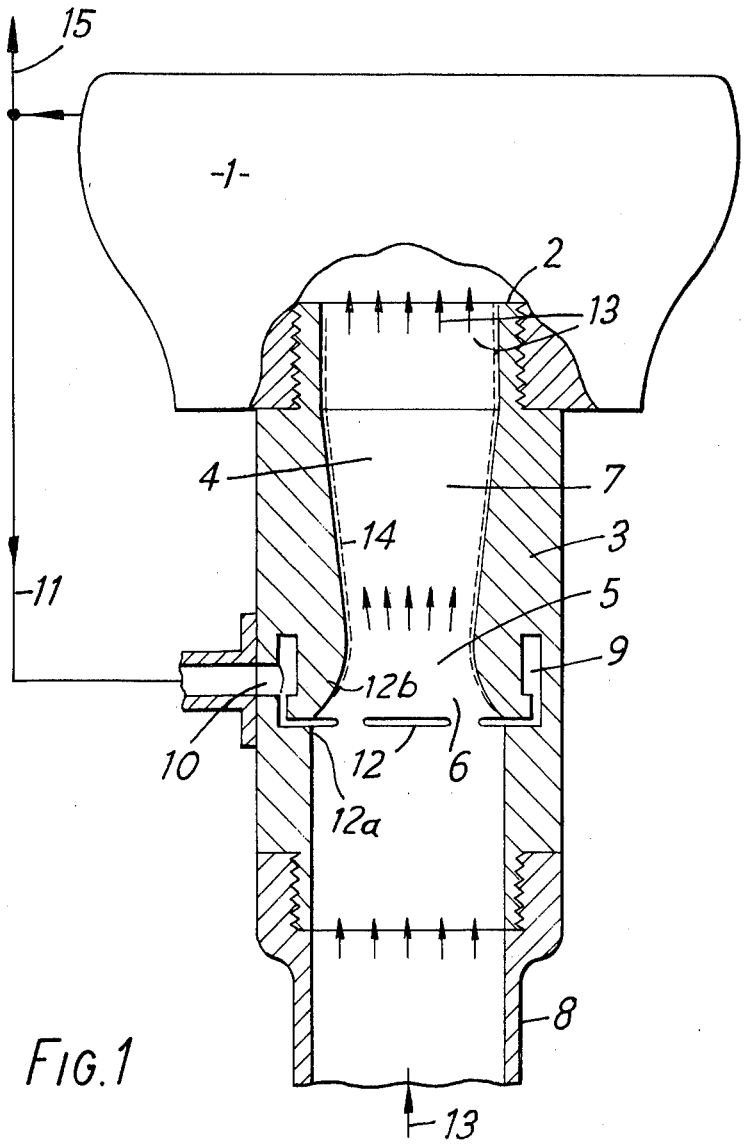
FIG. 1 is an elevation showing, in combination with a pump, for example an aircraft fuel booster pump, an axial section of a Venturi nozzle equipped with an injector system utilizing the Coanda effect.

Referring now first to FIG. 1, an impeller-type dynamic pump 1 constituting the fuel-backing pump of the fuel system of a jet-propulsion engine for an aircraft, has attached to it at its inlet aperture 2 an injector-housing body 3 formed with an axial nozzle passage 4 which leads from an external pipe 8 to the inlet aperture 2 of the pump. The nozzle passage constitutes a Venturi nozzle having a throat 5 which connects a convergent inlet or acceleration portion 6, whose cross-section decreases from its inlet side towards the throat, to a conically divergent diffusor portion 7 leading from the throat to the outlet end of the nozzle and the inlet aperture 2 of the pump. An annular chamber 9 is formed in the wall of the housing body 3, and this chamber is arranged to surround the throat portion 5 of the nozzle passage and to communicate through a bore 10 in the wall of the nozzle housing 3 with a line 11 for the supply of injection liquid under pressure. This liquid is admitted from the chamber 9 into the nozzle passage 4 through a number of slot-shaped ports 12 aligned in an annular array round the circumference of the nozzle passage 4 at the inlet end of the acceleration portion 6 of this passage. These slots define an annular zone substantially separating the passage wall into an upstream portion and a downstream portion, the mutually facing edges of said upstream and downstream protions being respectively formed as an upstream lip **12*a* and a downstream lip 12*b*. These passages, and in particular the downstream lips 12*b* are so arranged that, at least in the presence of a flow 13 along the nozzle passage 4, the fluid injected through the slots 12 tends, because of the Coanda effect, to flow through the throat 5 and the diffusor portion 7 of the Venturi nozzle in close contact with the wall surface of the passage 4. The profile of the nozzle passage in the acceleration portion 6 is therefore arranged to be gradually rounded or curved from the approximately radial direction in which liquid from the chamber 9 enters the passage 4 through the slots 12, in such a manner as to ensure that, when liquid flows through the nozzle passage 4 in the direction of the arrows 13, the liquid from line 11, the bore 10, and the annular chamber 9, which is injected under pressure through the slots 12, will adhere to this curved wall by the so-called Coanda effect and will flow along the wall of the acceleration portion 6, of the throat 5, and of the diffusor portion 7 as indicated at 14. This arrangement will produce an injector action assisting the flow of fluid along the nozzle passage 4 in the direction of the main stream 13 without the need of inserting into the nozzle passage a second coaxial nozzle liable to create obstruction in the free flow along the nozzle passage 4**.

The liquid under pressure supplied by the line 11 is obtained from the delivery side of the fuel-backing pump 1 to whose inlet the injection nozzle passage 4 leads. The liquid supply for the passage 11 is thus branched-off from the main flow 15 of liquid delivered by the backing pump to a main fuel pump for the jet-propulsion engine; but it will be readily appreciated that the pressure and liquid could alternatively be derived from a variety of other sources, provided that an adquate quantity of liquid which can, or is intended to be, used for the purpose, is available at a suitable pressure.

Figure 2:
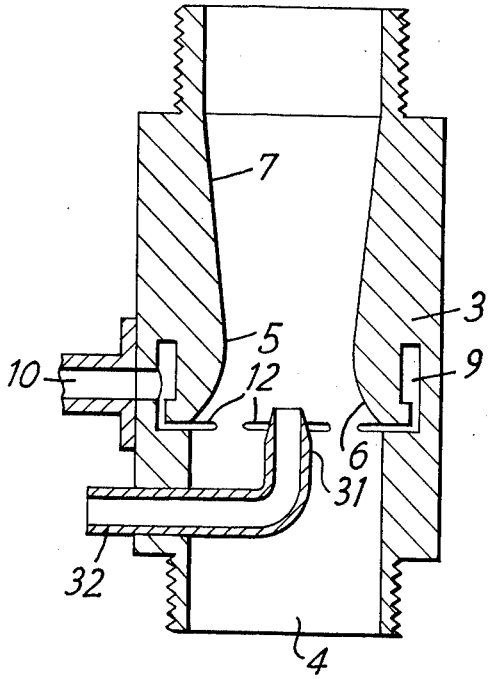
FIG. 2 is an axial section of an injector constructed in accordance with the present invention.

In FIG. 2, which illustrates a jet pump according to the invention which parts that are substantially identical in FIGS. 1 and 2 have been indicated by identical reference numbers. According to the invention, the arrangement as described with reference to FIG. 1 for introducing, through the ports 12, a substantially sleeve-like flow of injection fluid moving along the wall of the throat 5 and of the diffusor portion of the Venturi passage 4, are provided in a jet pump having a jet nozzle 31, which is arranged axially of the Venturi-nozzle passage and extends in the direction of flow and which terminates at a point upstream of the Venturi throat 5, preferably within the acceleration portion 6 of the Venturi nozzle. Injection fluid can be supplied to the jet nozzle 31 through a radial inlet duct 32 penetrating the wall of the Venturi nozzle housing 3. When both injection arrangements operate simultaneously, the layer of fluid moving along the wall of the diffusor portion 7 from the ports 12 will, by improving the efficiency of the diffusor, assist the jet-pump effect achieved by the operation of the central jet nozzle 31.

Figure 3:
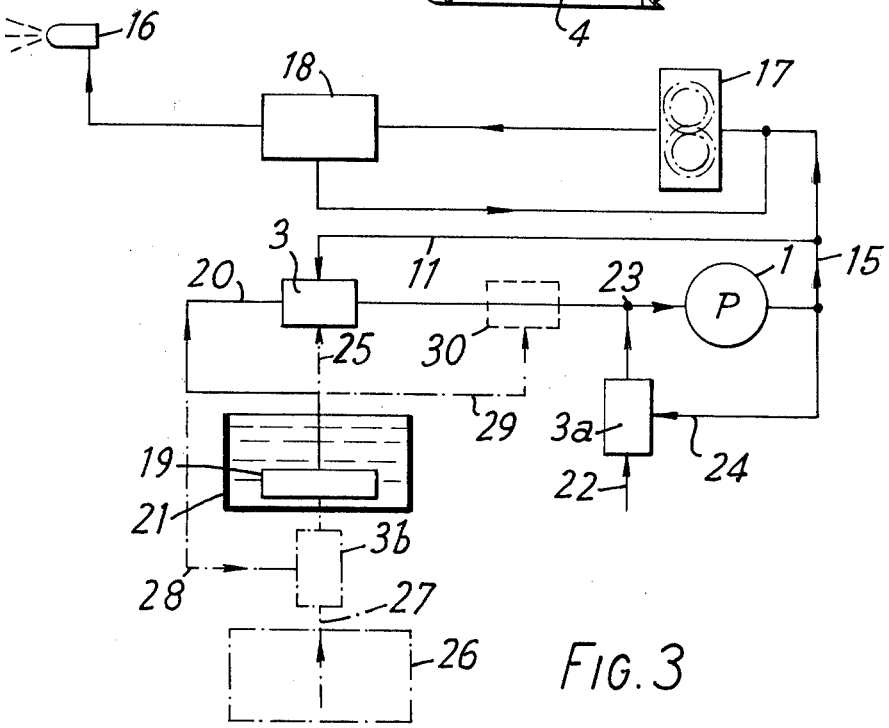
FIG. 3 is a flow diagram of an aircraft fuel system incorporating a number of injector systems arranged to operate in accordance with the present invention.

FIG. 3 is a diagram which illustrates a jet-aircraft fuel system in which injectors constructed according to the invention are arranged at various points and fed with pressurized injection liquid from a variety of other points of that system. The same reference numbers as in FIG. 1 have been used for corresponding parts. One injector 3 is arranged in an inlet feed line 20 for the fuel backing pump 1. Fuel delivered by the fuel backing pump 1 is arranged to be fed to engine burners 16 by a volumetric main fuel pump 17, which may be a gear-type pump, and a variable part of the output of the main fuel pump 17 is fed back to the inlet of that pump by a fuel controller 18 in a manner well-known to those skilled in the art. Fuel from a tank 21 is supplied to the backing pump 1 by means of a booster pump 19, which delivers it to the feed line 20. In this arrangement, which has been drawn in full lines, the booster pump 19 is immersed in the fuel tank 21, and the chamber 9 and slots 12 (not shown in FIG. 3) of the injector 3 are fed, as in FIG. 1, with liquid fuel under pressure via a line 11 from the delivery side of the backing pump 1. In order to permit low-pressure liquids such as fluid leakage from shaft seals, lubricating oil residues, condensates, etc., to be introduced into the fuel that is fed to the burner 16 by means of the backing pump 1 and main fuel pump 17, a waste-feed pipe 22 carrying these low-pressure liquids is connected to the inlet of the backing pump 1 at a branch point 23 after passing through a further injector 3*a* constructed similarly to the injector 3; a further branch line 24 from the delivery side of the backing pump 1 is arranged to supply the slots of this injector with injection liquid under pressure.

Various possible modifications are indicated in FIG. 3 in chain-dotted lines. According to one of these modifications, the line 11 feeding liquid under pressure to injector 3 from the delivery of the backing pump 1 may be replaced by an alternative supply through a line 25 from the outlet of the booster pump 19. This arrangement is believed to be convenient in some cases in which additional similar injectors 30, arranged in series with injector 3 and fed with injection liquid by a line 29, are provided at spaced points along the line 20 leading from the booster pump 19 to the backing pump 1. According to another modification the tank 21 in which the booster pump 19 is immersed in the described embodiment, may be replaced by an alternative tank 26, from which liquid is arranged to reach the inlet of the booster pump 19 via an inlet line 27, and which is positioned at a lower level than the booster pump 19. In order to ensure conveyance of the liquid from the tank 26 through the line 27 without undue liberation of vapor or gases, this line 27 is equipped with one or more injectors 3*b* which slots are fed with injection liquid under pressure by a line 28 branched off the delivery side of the booster pump 19. A line (not shown) supplying injection liquid to the injector 3*b* from the delivery side of the backing pump 1, may alternatively be employed if a higher pressure of the injection liquid is required.

It will be readily appreciated that the invention may be applied at other points of an aircraft fuel system or in some other liquid-pumping system, one application contemplated being, for example, the incorporation of injectors in the manner described in a tank-transfer line or at the inlet of a transfer pump similarly to the manner in which it has been shown with reference to FIG. 3 as applied to a booster pump and in the line transmitting the fuel from the booster pump to the backing pump. Also, while conditions making the use of the invention desirable will more particularly be found in high-flying aircraft which operate in a low ambient pressure, somewhat similar conditions are also liable to occur in burner systems which operate under more normal pressure conditions but in which temperatures are expected to be so high as to raise the vapor pressure of the fuel to a point near ambient pressure.

What we claim is:

1. In a system for supplying liquid fuel to an engine via a positive-displacement fuel pump, the system including a dynamic pump having an outlet leading to said positive-displacement pump and an inlet and producing an increase of pressure at said outlet over the pressure at said inlet, and an inlet line having a low-pressure inlet and having an increased-pressure outlet connected to the inlet of said dynamic pump, said inlet line comprising in combination:

a. an inlet-line member having solid walls forming a through passage and having means for attachment of said member to said dynamic pump with one end of the through passage connected to said inlet of the latter pump, said passage having a Venturi throat interposed between a first passage portion that extends from the throat to said one end of the passage, and a second passage portion that extends to the throat from the other end of the passage and includes a Venturi inlet and a convergent inlet portion leading from said Venturi inlet to the Venturi throat, said first passage portion including an outlet adjacent to said one end of the passage and a divergent diffusor portion leading from the throat to said outlet to form, jointly with said throat and said converging inlet portion, a Venturi-nozzle passage, said inlet portion, throat, and diffusor portion being all defined by said solid walls of said inlet-line member, and b. a jet-forming nozzle arranged in said through passage coaxially with said Venturi-nozzle passage to form and direct a high-speed jet of liquid coaxially into the convergent inlet portion of the Venturi nozzle passage towards the throat and divergent outlet portions thereof to become mixed with liquid aspired, by jet-pump action, through the Venturi inlet, thus forming a stream of the resulting mixed liquid flowing through said diffusor portion to said outlet and said inlet-line member being additionally formed with an annular array of ports constituting a Coanda-slot system encircling said convergent inlet portion and opening into the same through the passage wall defining said convergent inlet portion, said Coanda slot system defining an annular zone encircling the passage and substantially separating said wall into an upstream portion and a downstream portion, the mutually facing edges of said upstream and downstream portions being respectively formed as an upstream lip and a downstream lip, and with an injection-liquid passage leading from a point outside and said inlet-line member to said annular Coanda-slot system to discharge through said injection-liquid passage into said convergent inlet portion of the through passage, the wall defining said inlet portion including, extending from said downstream lip towards the Venturi throat, an annular zone whose surface forms a continuous extension of the surface of the downstream lip and recedes from the direction of discharge of said high-speed flow of liquid in the Coanda-slot system at a sufficiently gradual progression to ensure that the liquid thus discharged through the Coanda-slot system tends to follow, through said throat and said divergent outlet portion, due to the Coanda effect, the surface of the solid wall in said through passage and form there a layer of longitudinally moving liquid which, due to the Coanda effect, adheres to the said solid wall and thus separates the stationary surface of said wall from the said stream of mixed liquid.

2. An inlet line as claimed in claim 1, wherein said jet-forming nozzle terminates approximately at said inlet of said Venturi-nozzle passage.

3. A combination as claimed in claim 1 when incorporated in an aircraft fuel system which further comprises a fuel tank and a booster pump associated with the tank, said dynamic pump being a backing pump interposed between said booster pump and said positive-displacement fuel pump, and said booster pump delivering fuel from the tank to the backing pump through said inlet line.

* * * * *